United States Patent [19]

Sun et al.

[11] 4,155,717

[45] May 22, 1979

[54] PROCESS FOR REMOVING SULFUR FROM COAL EMPLOYING AQUEOUS SOLUTIONS OF SULFITES AND BISULFITES

[75] Inventors: Jui-Yuan Sun; Jin S. Yoo, both of South Holland; Emmett H. Burk, Jr., Glenwood, all of Ill.

[73] Assignee: Atlantic Richfield Company, Philadelphia, Pa.

[21] Appl. No.: 866,592

[22] Filed: Jan. 3, 1978

[51] Int. Cl.[2] ..... C10L 9/10; C10B 57/00

[52] U.S. Cl. ..... 44/1 R; 201/17

[58] Field of Search ..... 44/1 R, 4, 6, 16 F; 201/17

[56] References Cited

U.S. PATENT DOCUMENTS 1,311,221 7/1919 Ellis ..... 44/16 F 4,018,572 4/1977 Swanson ..... 44/1 R

FOREIGN PATENT DOCUMENTS 26692 of 1912 United Kingdom ..... 44/16 F 222702 10/1924 United Kingdom ..... 44/16 F

*Primary Examiner*—Carl Dees

*Attorney, Agent, or Firm*—John B. Goodman

[57] ABSTRACT

A process for reducing the sulfur content of coal comprising the steps of:

(1) contacting coal particles with an aqueous solution of compositions selected from the group comprising alkali metal and alkaline earth metal sulfites and bisulfites to reduce the sulfur content of the coal; and (2) recovering coal particles of reduced sulfur content.

10 Claims, No Drawings

PROCESS FOR REMOVING SULFUR FROM COAL EMPLOYING AQUEOUS SOLUTIONS OF SULFITES AND BISULFITES

BACKGROUND OF THE INVENTION

1. Field of the Invention

The field of this invention relates to a process for reducing the sulfur content of coal.

2. Prior Art

The problem of air pollution due to the emission of sulfur oxides when sulfur-containing fuels are burned has received increasing attention in recent years. It is now widely recognized that sulfur oxides can be particularly harmful pollutants since they can combine with moisture to form corrosive acidic compositions which can be harmful and/or toxic to living organisms in very low concentrations.

Coal is an important fuel, and large amounts are burned in thermal generating plants primarily for conversion into electrical energy. One of the principal drawbacks in the use of coal as a fuel is that many coals contain amounts of sulfur which generate unacceptable amounts of sulfur oxides on burning. For example, coal combustion is by far the largest single source of sulfur dioxide pollution in the United States at present, and currently accounts for 60 to 65% of the total sulfur oxide emissions.

The sulfur content of coal, nearly all of which is emitted as sulfur oxides during combustion, is present in essentially two forms: inorganic, primarily metal pyrites, and organic sulfur. The inorganic sulfur compounds are mainly iron pyrites, with lesser amounts of other metal pyrites and metal sulfates. The organic sulfur may be in the form of thiols, disulfide, sulfides and thiophenes chemically associated with the coal structure itself. Depending on the particular coal, the sulfur content can be primarily in the form of either inorganic sulfur or organic sulfur. Distribution between the two forms varies widely among various coals. For example, both Appalachian and Eastern interior coals are known to be rich in pyritic and organic sulfur. Generally, the pyritic sulfur represents from about 25% to 70% of the total sulfur content in these coals.

Heretofore, it was recognized that it would be highly desirable to remove (or at least lower) the sulfur content of coal prior to combustion. In this regard, a number of processes have been suggested for reducing the inorganic (pyritic) portion of the sulfur in coal.

For example, it is known that at least some pyritic sulfur can be physically removed from coal by grinding the coal, and subjecting the ground coal to froth flotation or washing processes. While such processes can desirably remove some p yritic sulfur and ash from the coal, these processes are not fully satisfactory because a significant portion of the pyritic sulfur is not removed. Attempts to increase the portion of pyritic sulfur removed have not been successful because these processes are not sufficiently selective. Because the process is not sufficiently selective, attempts to increase pyrite removal can result in a large portion of coal being discarded along with ash and pyrite. Organic sulfur cannot be physically removed from coal.

There have also been suggestions heretofore to chemically remove pyritic sulfur from coal. For example, U.S. Pat. No. 3,768,988 to Meyers, issued Oct. 30, 1973, discloses a process for reducing the pyritic sulfur content of coal involving exposing coal particles to a solution of ferric chloride. The patent suggest that in this process ferric chloride reacts with pyritic sulfur to provide free sulfur according to the following reaction process:

$$2FeCl_3+FeS_2 \rightarrow 3FeCl_2+S$$

While this process is of interest for removing pyritic sulfur, a disadvantage of the process is that the liberated sulfur solids must then be separated from the coal solids. Processes involving froth flotation, vaporization and solvent extraction are proposed to separate the sulfur solids. All of these proposals, however, inherently represent a second discrete process step with its attendant problems and cost which must be employed to remove the sulfur from coal. In addition, this process is notably deficient in that it cannot remove organic sulfur from coal.

In another approach, U.S. Pat. No. 3,824,084 to Dillon issued July 16, 1974, discloses a process involving grinding coal containing pyritic sulfur in the presence of water to form a slurry, and then heating the slurry under pressure in the presence of oxygen. The patent discloses that under these conditions the pyritic sulfur (for example, ($FeS_2$) can react to form ferrous sulfate and sulfuric acid which can further react to form ferric sulfate. The patent discloses that typical reaction equations for the process at the conditions specified are as follows:

$$FeS_2+H_2O+7/2O_2 \rightarrow FeSO_4+H_2SO_4$$

$$2FeSO_4+H_2SO_4+1/2O_2 \rightarrow Fe_2(SO_4)_3+H_2O$$

These reaction equations indicate that in this particular process the pyritic sulfur content continues to be associated with the iron as sulfate. Several factors detract from the desirability of this process. The oxidation of sulfur in the process does not proceed at a rapid rate, thereby limiting output for a given processing capacity. In addition, the oxidation process is not highly selective such that considerable amounts of coal itself can be oxidized. This is undesirable, of course, since the amount and/or heating value of the coal recovered from the process is decreased.

Numerous other methods have been proposed for reducing the pyritic sulfur content of coal. For example, U.S. Pat. No. 3,938,966, to Kindig et al issued Feb. 17, 1976, discloses treating coal with iron conbonyl to enhance the magnetic susceptibility of iron pyrites to permit removal with magnets.

In summary, while the problem of reducing the sulfur content of coal has received much attention, there still exists a present need for a practical method to more effectively reduce the sulfur content of coal.

SUMMARY OF THE INVENTION

This invention provides a practical method for more effectively reducing the sulfur content of coal. In summary, this invention involves a process for reducing the sulfur content of coal comprising the steps of:

(1) contacting coal particles with an aqueous solution of compositions selected from the group comprising alkali metal and alkaline earth metal sulfites and bisulfites to reduce the sulfur content of the coal; and (2) recovering coal particles of reduced sulfur content.

It has been discovered that contacting sulfur-containing coal with an aqueous solution of such alkali metal sulfites and bisulfites can remove pyritic sulfur, elemental sulfur and some organic sulfur from coal. An advantage of the process is that significant sulfur reduction is obtained without significant oxidation or other adverse modification of the coal substrate. A desirable result is that sulfur reduction is obtained without the amount and/or heating value of the coal being significantly decreased. Another advantage of the process is that sulfites are readily available and waste disposal problems are reduced.

DETAILED DESCRIPTION OF THE INVENTION AND ITS PREFERRED EMBODIMENTS

In its broad aspect, this invention provides a method for reducing the sulfur content of coal by a process comprising the steps of:

(1) contacting coal particles with an aqueous solution of compositions selected from the group comprising alkali metal and alkaline earth metal sulfites and bisulfites to reduce the sulfur content of the coal; and (2) recovering coal particles of reduced sulfur content.

The novel process of this invention can substantially reduce the pyritic sulfur content of coal employing readily available alkali metal and alkaline earth sulfite and bisulfite materials. In addition, the process does not produce by-products which present substantial disposal problems.

Suitable coals which can be employed in the process of this invention include brown coal, lignite, subbituminous, bituminous (high volatile, medium volatile, and low volatile), semi-anthracite, and anthracite. Regardless of the rank of the feed coal, excellent pyritic sulfur removal can be achieved by the process of this invention. Metallurgical coals, and coals which can be processed to metallurgical coals, containing sulfur in too high a content, can be particularly benefited by the process of this invention.

In the first step of the process of this invention, coal particles are contacted with an aqueous solution of a composition selected from the group comprising alkali metal and alkaline earth sulfites and bisulfites.

The coal particles employed in this invention can be provided by a variety of known processes, for example, grinding or crushing.

The particle size of the coal can vary over wide ranges. In general, the particles should be sufficiently small to enhance contacting with the aqueous medium. For instance, the coal may have an average particle size of one-eighth inch in diameter or larger in some instances, and as small as minus 200 mesh (Tyler Screen) or smaller. The rate of sulfur removal is faster the smaller the particle, but this advantage must be weighed against problems associated with obtaining the handling small particles. A very suitable particle size is often minus 5 mesh, preferably minus 18 mesh on 100 mesh as less effort is required for grinding and handling and yet the particles are sufficiently small to achieve an effective rate of sulfur removal.

The coal particles can be contacted with the aqueous solution of alkali metal sulfite by forming a mixture of the solution and coal particles. The mixture can be formed, for example, by grinding coal in the presence of water and adding a suitable amount of a composition comprising alkali metal and alkaline earth metal sulfites and bisulfites or an aqueous solution of such sulfites and bisulfites can be added to coal particles of a suitable size. Preferably, the mixture contains from about 5 to about 70%, by weight of the mixture, coal particles and more preferably from about 10 to about 40%, by weight of the mixture, coal particles.

The most suitable amount of sulfite or bisulfite employed depends upon the pyrite content of the coal, and the sulfite or bisulfite employed. It is generally convenient to employ aqueous solutions of sulfites and/or bisulfites which contain from about 0.1% to 20%, and preferably 2% to 10% by weight, alkali and/or alkaline metal sulfite and/or bisulfite including mixtures thereof.

Suitable alkali metal sulfites are potassium sulfite and sodium sulfite. Suitable alkali metal bisulfites are potassium bisulfite and sodium bisulfites. A suitable alkaline earth metal sulfite is calcium sulfite. The alkali metal sulfites are preferred for use in this invention.

It is contemplated that the suitable sulfites and bisulfites can be formed in situ, for example, by passing $SO_2$ gas into an alkaline aqueous slurry of coal. Other methods for formation of the sulfite and bisulfite in situ could be employed.

In accordance with this invention, to remove sulfur from coal a slurry of coal particles and an aqueous solution containing alkali metal and/or alkaline earth sulfite and/or bisulfite is formed.

Elevated temperatures can be desirably employed to accelerate the removal of sulfur from coal in the process. For example, temperatures of from about 100° C. to 500° C. preferably from about 200° to 500° C., and more preferably from about 250° to about 400° C., can be suitably employed. Under these reaction conditions, at least a portion of the sulfur in the coal, primarily pyritic sulfur can be rapidly removed without significant adverse affect on the coal substrate.

Elevated pressures can also desirably be employed to accelerate the process. For example, pressures of from 25 psig. to 1500 psig. or higher can be employed. At temperatures above 100° C. the autogeneous vapor pressure of water will, of course, provide elevated pressure and suitable equipment to contain such elevated pressure must be employed. A preferred pressure range is from 25 psig. to 500 psig.

The coal is held under these conditions for a period of time sufficient to remove a portion of the sulfur in the coal. The optimum time will depend upon the particular reaction conditions and the particular coal employed. Generally, a time period in the range of from about 30 minutes to 5 hours, or more, can be satisfactorily employed. Preferably, a time period of from 30 minutes to 4 hours is employed. During this time, it can be desirable to agitate the coal slurry. Known mechanical mixers, for example, can be employed to agitate the slurry.

The process step whereby the sulfur-containing coal is contacted with aqueous solution of sulfite or bisulfite may be carried out in any conventional manner, e.g., batchwise, semi-batchwise or continuously. Conventional equipment, such as, stirred tanks, agitated or stirred autoclaves can be employed in performing this contacting step.

This contacting step causes at least a portion of the sulfur in the sulfur-containing coal to form sulfur bearing compounds which can be separated from the coal, preferably as water soluble compounds.

After contacting sulfur-containing coal with an aqueous solution of alkali metal and/or alkaline earth sulfite and/or bisulfite in accordance with this invention, coal of reduced sulfur content can be separated from the solution. This separation may be performed using conventional procedures, such as filtering with bar sieves or screens, or centrifuging and may be performed on a batch basis or continuously. It is a desirable aspect of the invention that no major by-product of the process of the invention presents a significant disposal problem.

All parts, percentages and proportion herein are on a weight basis unless otherwise specified.

The following examples provide specific illustrations of the process of the present invention. However, these illustrations are not to be interpreted as specific limitations on the invention.

EXAMPLES I–VI

A sample of Coal (Somerset) was ground and screened to provide a quantity of coal having a particle size of 100× mesh.

The coal was treated in the following manner to reduce the sulfur content in the coal. A slurry of this coal and an aqueous solution containing 10% by weight sodium sulfite ($Na_2SO_3$) was formed. The resulting slurry contained 9%, by weight, coal. This slurry was charged to an autoclave. The autoclave was sealed and then heated to the temperature indicated, and held for a period of time at the indicated temperature. The autoclave was then cooled. The contents of the autoclave were then filtered to separate coal and the aqueous solution. The separated coal product was thoroughly washed with warm water, and dried.

The resulting coal product had an analysis on a dry, ash-free basis as present in the following Table I.

As can be seen from the analysis presented in Table I, the process of the invention provides a coal product substantially reduced in sulfur content.

TABLE I

| | | | | % By Weight Sulfur | | | | % Sulfur Removal | | |
|---|---|---|---|---|---|---|---|---|---|---|
| Example | Temp. ° C. | Time, hr. | Ash | Total | Sulfate | Pyritic | Organic | Total | Pyritic | Organic |
| | Somerset Feed Coal | | 17.4 | 4.45 | 0.14 | 3.13 | 1.17 | | | |
| I | 100 | 3 | 17.2 | 3.70 | 0.06 | 2.64 | 0.99 | 17 | 16 | 15 |
| II | 200 | 2 | 15.9 | 2.82 | 0.04 | 1.90 | 0.88 | 37 | 39 | 25 |
| III | 280 | 2 | 21.0 | 1.96 | 0.06 | 0.89 | 1.01 | 56 | 72 | 14 |
| IV | 280 | 1 | 19.3 | 2.49 | 0.05 | 1.50 | 0.94 | 44 | 52 | 20 |
| V | 300 | 1 | 20.0 | 2.11 | 0.10 | 0.98 | 1.04 | 53 | 69 | 11 |
| VI | 320 | 1 | 20.3 | 1.69 | 0.14 | 0.41 | 1.14 | 62 | 87 | 3 |

EXAMPLE VII

When in Examples I–VI, potassium sulfite, sodium bisulfite, calcium sulfite or mixtures thereof are employed in place of sodium sulfite, the same or similar results are obtained in that the sulfur content of the coal is reduced.

While this invention has been described with respect to various specific examples and embodiments, it is to be understood that the invention is not limited thereto and that it can be variously practiced within the scope of the following claims.

What is claimed is:

1. A process for reducing the sulfur content of coal comprising the steps of:

(1) contacting coal particles with an aqueous solution of compositions selected from the group comprising alkali metal and/or alkaline earth metal sulfites and/or bisulfites to reduce the sulfur content of the coal; and (2) recovering coal particles of reduced sulfur content.

2. The process of claim 1 wherein the aqueous solution is maintained at a temperature of from about 100° C. to 500° C.

3. The process of claim 2 wherein the coal is contacted with the aqueous solution for a period of 30 minutes to 5 hours.

4. The process of claim 3 wherein the coal particles are contacted with an aqueous solution of compositions selected from the group comprising alkali metal sulfites and bisulfites.

5. The process of claim 3 wherein the coal particles are contacted with an aqueous solution of compositions selected from the group comprising potassium sulfite, sodium sulfite or mixtures thereof.

6. The process of claim 3 wherein the coal particles are contacted with an aqueous solution of compositions selected from the group comprising alkaline earth metal sulfites and bisulfites.

7. The process of claim 4 wherein the temperature is from about 200° C. to 500° C.

8. The process of claim 6 wherein the temperature is from about 200° C. to 500° C.

9. The process of claim 4 wherein the temperature is from about 175° C. to 350° C.

10. The process of claim 5 wherein the temperature is from about 175° C. to 350° C.

* * * * *